US012780524B2

(12) United States Patent
Sollie

(10) Patent No.: US 12,780,524 B2
(45) Date of Patent: Nov. 3, 2026

(54) TEXTURED MAILER AND METHOD OF USE THEREFOR

(71) Applicant: Pratt Corrugated Holdings, Inc., Brookhaven, GA (US)

(72) Inventor: Greg Sollie, Sharpsburg, GA (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 469 days.

(21) Appl. No.: 18/151,220

(22) Filed: Jan. 6, 2023

(65) Prior Publication Data

US 2023/0234767 A1 Jul. 27, 2023

Related U.S. Application Data

(60) Provisional application No. 63/302,802, filed on Jan. 25, 2022.

(51) Int. Cl.
*B65D 81/03* (2006.01)
*B65D 27/14* (2006.01)

(52) U.S. Cl.
CPC ..... *B65D 81/03* (2013.01); *B65D 27/14* (2013.01)

(58) Field of Classification Search
CPC ..... B65D 27/14; B65D 81/03
See application file for complete search history.

(56) References Cited

U.S. PATENT DOCUMENTS

| | | | | |
|---|---|---|---|---|
| 1,945,024 A | | 1/1934 | Coil et al. | |
| 2,036,051 A | | 3/1936 | Kieffer | |
| 2,106,246 A | | 1/1938 | Fourness | |
| 2,345,844 A | | 4/1944 | Weiss | |
| 2,502,113 A | | 3/1950 | Walker | |
| 2,896,692 A | | 7/1959 | Camillo | |
| 3,642,967 A | | 2/1972 | Doll | |
| 3,672,950 A | | 6/1972 | Murphy et al. | |
| 3,867,874 A | | 2/1975 | O'Neil | |
| 4,580,683 A | | 4/1986 | Gochenour | |
| 4,620,633 A | * | 11/1986 | Lookholder | B65D 81/03 53/472 |

(Continued)

FOREIGN PATENT DOCUMENTS

| | | |
|---|---|---|
| CH | 372913 | 10/1963 |
| CN | 108639567 | 10/2018 |

(Continued)

OTHER PUBLICATIONS

ECOENCLOSE; Article entitled: "100% Recycled Indented Kraft Paper Roll—24"x360"", located at <https://www.ecoenclose.com/100-recycled-indented-kraft-paper-roll-24-x-360/>, accessed on Oct. 14, 2021, 5 pgs.

(Continued)

*Primary Examiner* — Derek J Battisti
(74) *Attorney, Agent, or Firm* — Smith, Gambrell & Russell, LLP

(57) ABSTRACT

A textured mailer includes a first panel comprising at least a first paper layer; a second panel coupled to and facing the first panel and comprising at least a second paper layer; and an inner cavity defined between the first panel and the second panel, wherein at least one of the first paper layer and the second paper layer is formed as a textured paper layer configured to provide cushioning to contents of the inner cavity.

20 Claims, 9 Drawing Sheets

(56) References Cited

U.S. PATENT DOCUMENTS

| | | | | |
|---|---|---|---|---|
| 4,861,170 | A * | 8/1989 | Patriksson | B65D 31/04 383/20 |
| D310,953 | S | 10/1990 | Ilukowicz et al. | |
| 5,273,361 | A * | 12/1993 | Jillson | B32B 27/10 383/93 |
| 5,374,468 | A | 12/1994 | Babinsky et al. | |
| D364,812 | S | 12/1995 | Breton | |
| 5,593,755 | A | 1/1997 | Fuss | |
| 5,667,871 | A | 9/1997 | Goodrich et al. | |
| 5,688,578 | A | 11/1997 | Goodrich | |
| 5,782,735 | A | 7/1998 | Goodrich et al. | |
| 5,799,862 | A | 9/1998 | Gray | |
| 5,897,481 | A | 4/1999 | Baumuller | |
| 5,910,079 | A | 6/1999 | Watanabe | |
| 6,647,697 | B1 | 11/2003 | Zarrow et al. | |
| 6,716,498 | B2 | 4/2004 | Curro et al. | |
| 6,808,791 | B2 | 10/2004 | Curro et al. | |
| 6,863,960 | B2 | 3/2005 | Curro et al. | |
| 6,878,433 | B2 | 4/2005 | Curro et al. | |
| 6,913,389 | B2 | 7/2005 | Kannankeril et al. | |
| D513,182 | S | 12/2005 | Deluca et al. | |
| 6,986,932 | B2 | 1/2006 | Zink et al. | |
| 7,037,569 | B2 | 5/2006 | Curro et al. | |
| 7,255,910 | B1 | 8/2007 | Seckel | |
| D617,642 | S | 6/2010 | Jonzon et al. | |
| 7,807,253 | B2 | 10/2010 | Kannankeril | |
| 7,846,518 | B2 | 12/2010 | Hahn | |
| D640,557 | S | 6/2011 | Wehrmann | |
| 8,052,037 | B2 | 11/2011 | Bussey, III et al. | |
| D659,022 | S | 5/2012 | Kemner | |
| 8,449,968 | B2 | 5/2013 | Mueller et al. | |
| 8,613,993 | B2 | 12/2013 | Kuchar | |
| 9,045,271 | B2 | 6/2015 | Matheison et al. | |
| 9,315,312 | B2 | 4/2016 | De Luca et al. | |
| 9,376,280 | B2 | 6/2016 | Page et al. | |
| D770,282 | S | 11/2016 | Ye et al. | |
| 9,533,809 | B2 | 1/2017 | Kuchar et al. | |
| 9,643,754 | B2 | 5/2017 | Brogan | |
| 9,701,091 | B2 | 7/2017 | Page et al. | |
| D817,521 | S | 5/2018 | Bordin | |
| 9,963,283 | B2 | 5/2018 | Page et al. | |
| 10,226,907 | B2 | 3/2019 | Goodrich | |
| 10,442,574 | B2 | 10/2019 | Kuchar et al. | |
| 10,569,495 | B2 | 2/2020 | Waldrop, III et al. | |
| D876,843 | S | 3/2020 | Zhang | |
| 10,669,086 | B2 | 6/2020 | Goodrich | |
| 10,717,583 | B2 | 7/2020 | Hoffman et al. | |
| D898,382 | S | 10/2020 | Delaney et al. | |
| 10,850,891 | B2 | 12/2020 | Yan | |
| 10,870,949 | B2 | 12/2020 | De Luca | |
| D906,814 | S | 1/2021 | Hsieh | |
| 10,981,712 | B2 | 4/2021 | Goodrich | |
| 11,981,492 | B2 | 5/2024 | Moore et al. | |
| 12,043,015 | B2 | 7/2024 | Sollie et al. | |
| 12,214,576 | B2 | 2/2025 | Sollie et al. | |
| 12,415,331 | B2 | 9/2025 | Sollie et al. | |
| 12,466,154 | B2 | 11/2025 | Sollie et al. | |
| 12,473,134 | B2 | 11/2025 | Sollie et al. | |
| 12,515,866 | B2 | 1/2026 | Moore et al. | |
| 2001/0031339 | A1 | 10/2001 | Johnson | |
| 2003/0021649 | A1 | 1/2003 | Shetty | |
| 2003/0029767 | A1 | 2/2003 | Collins | |
| 2004/0000581 | A1 | 1/2004 | Brandolini et al. | |
| 2004/0076798 | A1 | 4/2004 | Larsson | |
| 2005/0173506 | A1* | 8/2005 | Bartlett | B65D 27/14 229/80 |
| 2006/0210773 | A1* | 9/2006 | Kannankeril | B29C 66/438 206/522 |
| 2007/0082181 | A1* | 4/2007 | Jung | B32B 3/085 428/182 |
| 2008/0029583 | A1 | 2/2008 | Korijio | |
| 2010/0028611 | A1 | 2/2010 | Adie | |
| 2011/0127189 | A1 | 6/2011 | Liao et al. | |
| 2011/0266334 | A1 | 11/2011 | Keltsch | |
| 2011/0318522 | A1 | 12/2011 | Mueller et al. | |
| 2012/0104009 | A1 | 5/2012 | Fascio | |
| 2012/0248177 | A1* | 10/2012 | Beaulieu | B65D 81/03 229/80.5 |
| 2013/0171422 | A1 | 7/2013 | De Luca et al. | |
| 2014/0117071 | A1* | 5/2014 | Kannankeril | B65D 81/03 229/68.1 |
| 2015/0024172 | A1 | 1/2015 | Pollock | |
| 2015/0175331 | A1 | 6/2015 | Sheu et al. | |
| 2017/0203866 | A1 | 7/2017 | Goodrich | |
| 2018/0093441 | A1 | 4/2018 | Wetsch | |
| 2018/0162597 | A1 | 6/2018 | Jobe | |
| 2018/0334211 | A1 | 11/2018 | Mertens et al. | |
| 2018/0370702 | A1 | 12/2018 | Goodrich | |
| 2019/0062028 | A1 | 2/2019 | Getty et al. | |
| 2020/0031556 | A1 | 1/2020 | Jobe | |
| 2020/0039720 | A1 | 2/2020 | Goodrich | |
| 2020/0055272 | A1 | 2/2020 | Boex | |
| 2020/0247079 | A1 | 8/2020 | Goodrich | |
| 2020/0247105 | A1 | 8/2020 | Getty et al. | |
| 2020/0307866 | A1 | 10/2020 | Yan | |
| 2020/0307867 | A1 | 10/2020 | Yan | |
| 2021/0061535 | A1* | 3/2021 | Moore | B32B 29/08 |
| 2021/0078280 | A1 | 3/2021 | Bergmann | |
| 2021/0130070 | A1* | 5/2021 | Zhu | B32B 27/32 |
| 2021/0221567 | A1 | 7/2021 | Yan | |
| 2022/0032572 | A1 | 2/2022 | Sollie et al. | |
| 2022/0153478 | A1 | 5/2022 | Mayer et al. | |
| 2023/0130696 | A1 | 4/2023 | Sollie et al. | |
| 2023/0150748 | A1 | 5/2023 | Sollie et al. | |
| 2024/0262596 | A1 | 8/2024 | Moore et al. | |
| 2024/0286375 | A1 | 8/2024 | Sollie et al. | |
| 2025/0178305 | A1 | 6/2025 | Sollie et al. | |
| 2026/0042274 | A1 | 2/2026 | Sollie et al. | |
| 2026/0042591 | A1 | 2/2026 | Sollie et al. | |

FOREIGN PATENT DOCUMENTS

| | | | | |
|---|---|---|---|---|
| DE | 7730285 | | 1/1978 | |
| DE | 7735721 | | 6/1983 | |
| DE | 8913282 | | 1/1990 | |
| DE | 9302138 | | 5/1993 | |
| DE | 9313414 | | 11/1993 | |
| EP | 0553413 | | 8/1993 | |
| EP | 2463088 | | 6/2012 | |
| EP | 3564146 | | 11/2019 | |
| GB | 2093403 | | 9/1982 | |
| GB | 2488509 | | 9/2012 | |
| JP | 2010228111 | | 10/2010 | |
| WO | 0000408 | | 1/2000 | |
| WO | 2014175792 | | 10/2014 | |
| WO | 2018185213 | | 10/2018 | |
| WO | 2021046395 | | 3/2021 | |
| WO | WO-2021155145 | A1 * | 8/2021 | F25D 11/006 |
| WO | 2023146805 | | 8/2023 | |

OTHER PUBLICATIONS

Jakodan; Article entitled: "Bubble Paper 25 CM", located at <https://www.jakodan.com/boble-papir-25-cm.html>, accessed on Oct. 14, 2021, 2 pgs.

Kite Packaging Ltd; Article entitled: "Bubble Wrap (mcp/bubble-wrap/) > Paper bubble wrap", accessed on Oct. 13, 2021, 3 pgs.

Moore, Benjamin Edward Lee; International Search Report and Written Opinion for PCT/US2020/049467, filed Sep. 4, 2020, mailed Dec. 10, 2020, 10 pgs.

Moore, Benjamin Edward Lee; Non-Final Office Action for U.S. Appl. No. 17/012,870, filed Sep. 4, 2020, mailed Oct. 6, 2022, 13 pgs.

Moore, Benjamin Edward Lee; Restriction Requirement for U.S. Appl. No. 17/012,870, filed Sep. 4, 2020, mailed Sep. 2, 2022, 6 pgs.

Sollie, Greg; Requirement for Restriction/Election for U.S. Appl. No. 17/177,908, filed Feb. 17, 2021, mailed Sep. 6, 2022, 7 pgs.

amazon.com; Article entitled: C-Line Heavy Duty Super Heavy-weight Plus Stitched Shop Ticket Holder, Black, 9 x 12 Inches, Box

(56) References Cited

OTHER PUBLICATIONS of 15 Shop Ticket Holders (50912)>, available at https://www.amazon.com/C-Line-Heavyweight-Stitched-Holders-50912/dp/B00MMR24G2/>, accessed on Jan. 11, 2023, 8 pgs.
JBM Packaging; Article entitled: "Commercial Seed Packets", located at <https://www.jbmpackaging.com/products/premium-packets/commercial-seed-packets/>, accessed on Jan. 11, 2023, 10 pgs.
Product Packaging Supplies; Article entitled: "34-6-56-9-3/4" X 12-1/4" Stayflats Plus Peel-and-Seal Mailer—Kraft", located <https://productpackagingsupplies.com/Item/9_3_4x12_1_4_Stayflats_Plus_Peel_and_Seal_Mailer_Kraft>, accessed on Jan. 11, 2023, 6 pgs.
Sollie, Greg; Non-Final Office Action for U.S. Appl. No. 17/177,908, filed Feb. 17, 2021, mailed Jan. 13, 2023, 31 pgs.
Moore, Benjamin Edward Lee; Notice of Allowance for U.S. Appl. No. 18/636,656, filed Apr. 16, 2024, mailed Sep. 10, 2025, 9 pgs.
Moore, Benjamin Edward Lee; Notice of Allowance for U.S. Appl. No. 17/012,870, filed Sep. 4, 2020, mailed Jan. 10, 2024, 7 pgs.
Sollie, Greg; Non-Final Office Action for U.S. Appl. No. 17/177,908, filed Feb. 17, 2021, mailed Feb. 12, 2024, 25 pgs.
Sollie, Greg; Notice of Allowance for U.S. Appl. No. 18/146,244, filed Dec. 23, 2022, mailed Feb. 7, 2024, 12 pgs.
Sollie, Greg; Final Office Action for U.S. Appl. No. 17/177,908, filed Feb. 17, 2021, mailed May 24, 2024, 24 pgs.
Moore, Benjamin Edward Lee; Final Office Action for U.S. Appl. No. 18/636,656, filed Apr. 16, 2024, mailed Jun. 12, 2025, 5 pgs.
Sollie, Greg; Notice of Allowance for U.S. Appl. No. 17/177,908, filed Feb. 17, 2021, mailed May 19, 2025, 12 pgs.
Sollie, Greg; Non-Final Office Action for U.S. Appl. No. 18/099,502, filed Jan. 20, 2023, mailed Jun. 4, 2025, 29 pgs.
Sollie, Greg; Notice of Allowance for U.S. Appl. No. 18/099,502, filed Jan. 20, 2023, mailed Jul. 17, 2025, 8 pgs.
Sollie, Greg; Notice of Allowance for U.S. Appl. No. 19/043,816, filed Feb. 3, 2025, mailed Jul. 8, 2025, 8 pgs.
Sollie, Greg; Non-Final Office Action for U.S. Appl. No. 17/177,908, filed Feb. 17, 2021, mailed Sep. 12, 2024, 26 pgs.
Sollie, Greg; Non-Final Office Action for U.S. Appl. No. 18/099,502, filed Jan. 20, 2023, mailed Aug. 15, 2024, 56 pgs.
Sollie, Greg; Non-Final Office Action for U.S. Appl. No. 18/655,030, filed May 3, 2024, mailed Aug. 22, 2024, 28 pgs.
Sollie, Greg; International Preliminary Report on Patentability for PCT Application No. PCT/US2023/11269, filed Jan. 20, 2023, mailed Aug. 8, 2024, 11 pgs.
Sollie, Greg; Requirement for Restriction/Election for U.S. Appl. No. 18/146,244, filed Dec. 23, 2022, mailed May 23, 2023, 7 pgs.
Sollie, Greg; International Search Report and Written Opinion for PCT Application No. PCT/US2023/11269, filed Jan. 20, 2023, mailed Apr. 5, 2023, 13 pgs.
Moore, Benjamin Edward Lee; Non-Final Office Action for U.S. Appl. No. 18/636,656, filed Apr. 16, 2024, mailed Dec. 13, 2024, 14 pgs.
Sollie, Greg; Final Office Action for U.S. Appl. No. 18/099,502, filed Jan. 20, 2023, mailed Dec. 3, 2024, 33 pgs.
Sollie, Greg; Notice of Allowance for U.S. Appl. No. 18/655,030, filed May 3, 2024, mailed Nov. 19, 2024, 12 pgs.
Moore, Benjamin Edward Lee; Non-Final Office Action for U.S. Appl. No. 17/012,870, filed Sep. 4, 2020, mailed Jul. 7, 2023, 6 pgs.
Sollie, Greg; Final Office Action for U.S. Appl. No. 17/177,908, filed Feb. 17, 2021, mailed Jul. 25, 2023, 25 pgs.
Sollie, Greg; Non-Final Office Action for U.S. Appl. No. 18/146,244, filed Dec. 23, 2022, mailed Sep. 20, 2023, 34 pgs.
Sollie, Greg; Non-Final Office Action for U.S. Appl. No. 18/099,502, filed Jan. 20, 2023, mailed Feb. 20, 2025, 29 pgs.
Sollie, Greg; Non-Final Office Action for U.S. Appl. No. 19/043,816, filed Feb. 3, 2025, mailed May 8, 2025, 18 pgs.

* cited by examiner

TEXTURED MAILER AND METHOD OF USE THEREFOR

CROSS-REFERENCE TO RELATED APPLICATIONS

The present application claims the benefit of U.S. Provisional Application No. 63/302,802, filed Jan. 25, 2022, which is hereby specifically incorporated by reference herein in its entirety.

TECHNICAL FIELD

This disclosure relates to cushioning materials. More specifically, this disclosure relates a mailer comprising textured materials for cushioning the mailer.

BACKGROUND

Cushioning sheets, such as wrapping paper and bubble wrap, are often used as cushioning for fragile objects during shipping. Wrapping paper typically comprises a single, thin sheet of paper that can be bunched up and packed around the object to limit movement of the object within a package and to provide cushioning from heavy impacts. However, wrapping paper easily crumples under force, and, once crumpled, can lose its volume and effectiveness. Bubble wrap typically comprises a plastic sheet defining air fill pockets. However, typical plastic bubble wrap is not recyclable.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a textured mailer comprising an outer layer defining an outer surface of the textured mailer, the outer layer comprising an outer textured panel disposed at a first side of the textured mailer; and an inner layer coupled to the outer layer and defining an inner surface of the textured mailer, the inner surface defining an interior cavity of the textured mailer, the inner layer comprising an inner textured panel disposed at a second side of the textured mailer opposite the first side; wherein the interior cavity is substantially surrounded by the outer textured panel and the inner textured panel.

Also disclosed is a textured mailer comprising a first paper layer; and a second paper layer coupled to the first paper layer, the first and second paper layers folded to define a cavity; wherein at least one of the first paper layer and the second paper layer defines a plurality of sockets, and wherein the plurality of sockets comprises a first set of sockets arranged at a front side of the textured mailer and a second set of sockets arranged at a rear side of the textured mailer.

Additionally, disclosed is a textured mailer comprising a first panel comprising at least a first paper layer; a second panel coupled to and facing the first panel and comprising at least a second paper layer; and an inner cavity defined between the first panel and the second panel, wherein at least one of the first paper layer and the second paper layer is formed as a textured paper layer configured to provide cushioning to contents of the inner cavity.

A method of using a textured mailer is disclosed, the method comprising providing the textured mailer, wherein the textured mailer is configurable in an unsealed configuration and a sealed configuration and comprises: a first panel comprising at least a first paper layer; a second panel coupled to and facing the first panel and comprising at least a second paper layer; and an inner cavity defined between the first panel and the second panel, wherein at least one of the first paper layer and the second paper layer is formed as a textured paper layer; inserting contents into the inner cavity in the unsealed configuration, wherein the textured paper layer provides cushioning to the contents; and sealing the textured mailer in the sealed configuration to retain the contents within the inner cavity.

Furthermore, disclosed is a textured mailer comprising a first paper layer; and a second paper layer coupled to the first paper layer, the first and second paper layers folded to define an inner cavity; wherein the first paper layer defines a plurality of sockets, and wherein the plurality of sockets comprises a first set of the sockets arranged at a front side of the textured mailer and a second set of the sockets arranged at a rear side of the textured mailer.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
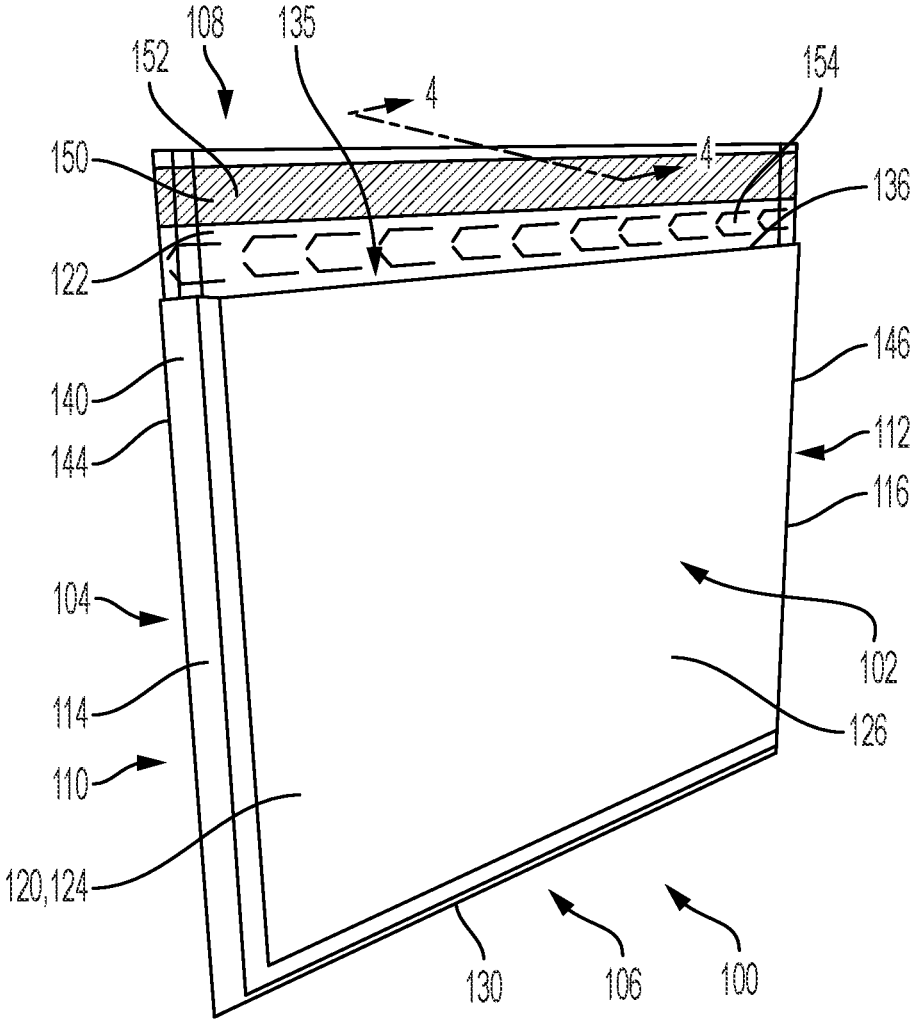
FIG. 1 is a front perspective view of a textured mailer, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a textured mailer and associated methods, systems, devices, and various apparatus. Example aspects of the textured mailer can comprise an inner layer and an outer layer. It would be understood by one of skill in the art that the textured mailer is described in but a few exemplary embodiments among many. No particular terminology or description should be considered limiting on the disclosure or the scope of any claims issuing therefrom.

FIG. 1 illustrates a front perspective view of a textured mailer 100 in a folded configuration, in accordance with an example aspect of the present disclosure. According to example aspects, the textured mailer 100 can comprise an outer layer 120 and an inner layer 320 (shown in FIG. 3). Other aspects of the textured mailer 100 can comprise more or fewer layers; for example, in another aspect, the textured mailer 100 can comprise the outer layer 120, the inner layer 320, and an intermediate layer therebetween. The outer layer 120 can define an inner surface 122 and an outer surface 124. The outer layer 120 can comprise a paper material, and thus, the outer layer 120 can be a paper outer layer 120. In some aspects, the paper material can be recyclable, and in some aspects the paper material can be single stream repulpable. Additionally, in some aspects, the paper material can be a tissue-grade paper material. Furthermore, in some aspects, a coating can be applied to the paper material of the outer layer 120 to increase the strength of the outer layer 120 while maintaining flexibility. The coating can be, for example and without limitation, a starch-based coating. In some aspects, the paper material can be extensible, such that the outer layer 120 can be stretchable. In other aspects, the outer layer 120 can comprise any other suitable material known in the art, may or may not comprise the coating, and/or can be inextensible.

Figure 2:
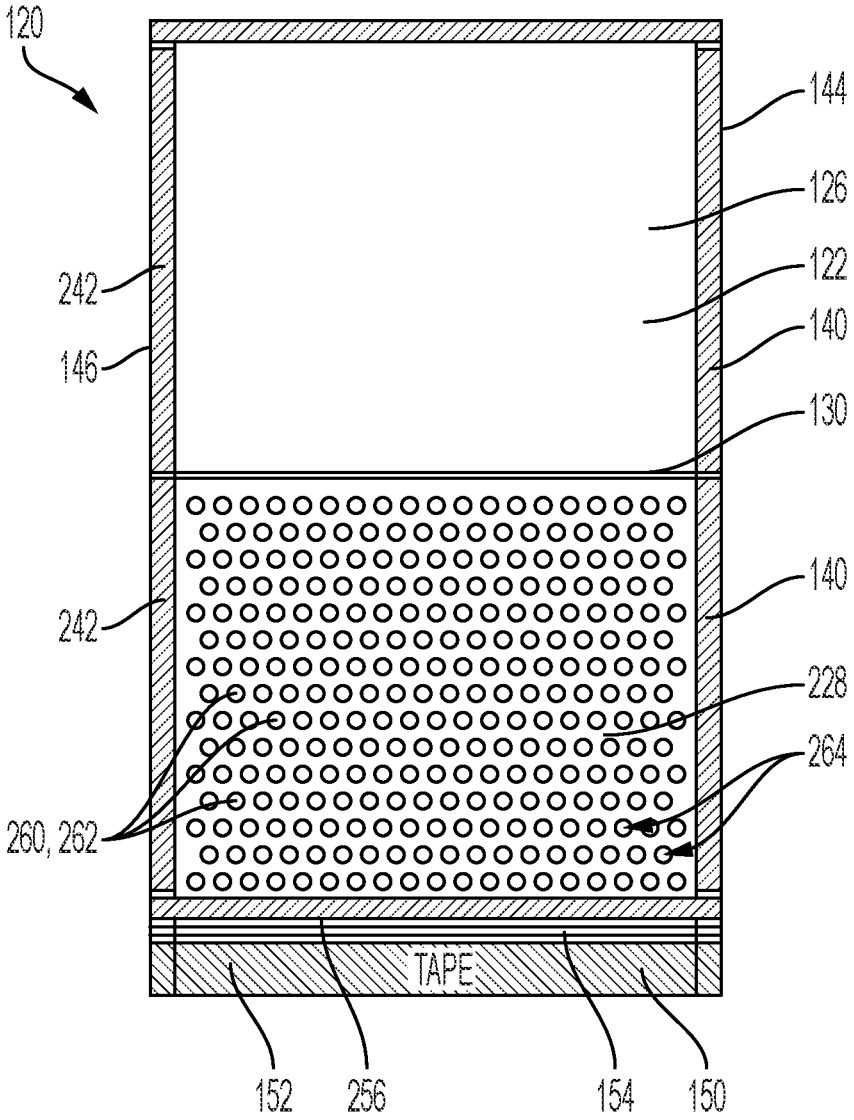
FIG. 2 is a top plan view of an outer layer of the textured mailer of FIG. 1.

Example aspects of the outer layer 120 can comprise an outer front panel 126 and an outer rear panel 228 (shown in FIG. 2). The outer front panel 126 can be folded towards the outer rear panel 228 at a lower outer bend line 130, as shown, such that the outer front panel 126 can be disposed at a front side 102 of the textured mailer 100 and the outer rear panel 228 can be disposed at a rear side 104 of the textured mailer 100. The outer front panel 126 and the outer rear panel 228 can be oriented about parallel with one another. In example aspects, the outer front panel 126 can be substantially smooth and planar, and the outer rear panel 228 can be textured, as described in further detail below. The smoothness of the outer front panel 126 can allow for sticker labels to be easily adhered to the outer front panel 126 and/or can allow for easy writing of mailing addresses or other information thereon. In other aspects, the outer front panel 126 can be textured, and the outer rear panel 228 can be substantially smooth and planar. In other aspects, both of the outer front panel 126 and the outer rear panel 228 can be textured, or both of the outer front panel 126 and the outer rear panel 228 can be substantially smooth and planar.

The inner surface 122 of the outer layer 120 can define an outer cavity 135 between the outer front panel 126 and the outer rear panel 228. The outer cavity 135 can be sealed at a lower end 106 of the textured mailed by the lower outer bend line 130. Each of the outer front panel 126 and the outer rear panel 228 can define a left sealing portion 140 extending along a left edge 144 thereof and a right sealing portion 242 (shown in FIG. 2) extending along a right edge 146 thereof. According to example aspects, the left sealing portion 140 of the outer front panel 126 can be coupled to the left sealing portion 140 of the rear front panel to define a left seam 114 and to seal the outer cavity 135 at a left side 110 of the textured mailer 100. Similarly, the right sealing portion 242 of the outer front panel 126 can be coupled to the right sealing portion 242 of the outer rear panel 228 to define a right seam 116 and to seal the outer cavity 135 at a right side 112 of the textured mailer 100. In example aspects, the right sealing portions 242 can be secured together at the right side 112 by an adhesive, and the left sealing portions 140 can be secured together at the left side 110 by an adhesive. The adhesives can be, for example, glue or tape. In other aspects, the right sealing portions 242 can be secured together and the left sealing portions 140 can be secured together by any other suitable fastener or fastening technique known in the art. According to example aspects, the textured mailer 100 can further comprise the inner layer 320 (shown in FIG. 3), which can be disposed substantially within the outer cavity 135 in the folded configuration. In example aspects, the inner layer 320 can be secured to the outer layer 120 in an unfolded configuration, and then the textured mailer 100 can be folded to the folded configuration, as described in further detail below.

A cavity opening 136 can be defined generally at or near an upper end 108 of the textured mailer 100. The inner layer 320 can be inserted into the outer cavity 135 through the cavity opening 136. Example aspects of the textured mailer 100 can be configured in an unsealed configuration, as shown, and a sealed configuration. In the unsealed configuration, the cavity opening 136 can be uncovered to allow access to the outer cavity 135. In the sealed configuration, the cavity opening 136 can be covered by a sealing flap 150 of the textured mailer 100 to seal the outer cavity 135 at the upper end 108, thereby containing contents received within the textured mailer 100. According to example aspects, the sealing flap 150 can extend substantially upward, relative to the orientation shown, from the outer rear panel 228. In some aspects, a tape strip 152 can be applied substantially along a length of the sealing flap 150 on the inner surface 122. To seal the textured mailer 100 in the sealed configuration, the sealing flap 150 can be folded relative to the outer rear panel 228 over the cavity opening 136, and the tape strip 152 can be adhered to the outer front panel 126 on the outer surface 124. In some aspects, a backing can cover the tape strip 152 in the unsealed configuration and can be peeled off to reveal the tape strip 152 prior to sealing the textured mailer 100. In other aspects, the sealing flap 150 can be secured to the outer front panel 126 by any other suitable fastener or fastening technique. Moreover, in some aspects, the sealing flap 150 can comprise a tear strip 154 disposed between the tape strip 152 and the outer rear panel 228, and extending along the length of the sealing flap 150. The tear strip 154 can be torn away from the textured mailer 100 to facilitate opening the textured mailer 100 from the sealed configuration. Other aspects of the textured mailer 100 may not comprise the tear strip 154 and/or the tape strip 152.

FIG. 2 is a top plan view of the outer layer 120 of the textured mailer 100 (shown in FIG. 1) in an unfolded configuration, illustrating the inner surface 122 thereof. As shown, the outer front panel 126 can be hingedly coupled to the outer rear panel 228 by the lower outer bend line 130. Each of the outer front panel 126 and the outer rear panel 228 can define the corresponding left sealing portion 140 and right sealing portion 242. The sealing flap 150 can extend from the outer rear panel 228, opposite the outer front panel 126. In some aspects, the sealing flap 150 can be hingedly connected to the outer rear panel 228 at an upper outer bend line 256. The sealing flap 150 can define both the tape strip 152 and the tear strip 154. According to example aspects, the outer front panel 126 can be substantially smooth and planar, and the outer rear panel 228 can be textured. For example, the textured outer rear panel 228 can define a plurality of spaced-apart outer sockets 260 formed therein.

In the present aspect, each of the outer sockets 260 can be formed as a substantially semi-spherical dome 262 defining a substantially semi-spherical recess 264. Furthermore, each of the outer sockets 260 can be substantially uniform in size and shape, and can extend in the same direction. For example, each of the outer sockets 260 can extend rearwardly from the rear side 104 (shown in FIG. 4A) of the textured mailer 100. As such, the outer sockets 260 can extend into the page in the present view. In other aspects, however, the outer sockets 260 can vary in size and/or shape, and/or the outer sockets 260 can vary in direction (i.e., some of the outer sockets 260 can extend rearwardly from the rear side 104 of the textured mailer 100 and some of the outer sockets 260 can extend forwardly towards the front side 102—shown in FIG. 4*a*—of the textured mailer 100). The outer sockets 260 can also be arranged in any suitable pattern, such as in diagonal lines, as shown. According to example aspects, outer sockets 260 can be formed in the outer layer 120 by a rolling machine, as described in U.S. application Ser. No. 17/177,908, filed Feb. 17, 2021, which is hereby incorporated by reference herein in its entirety.

Figure 3:
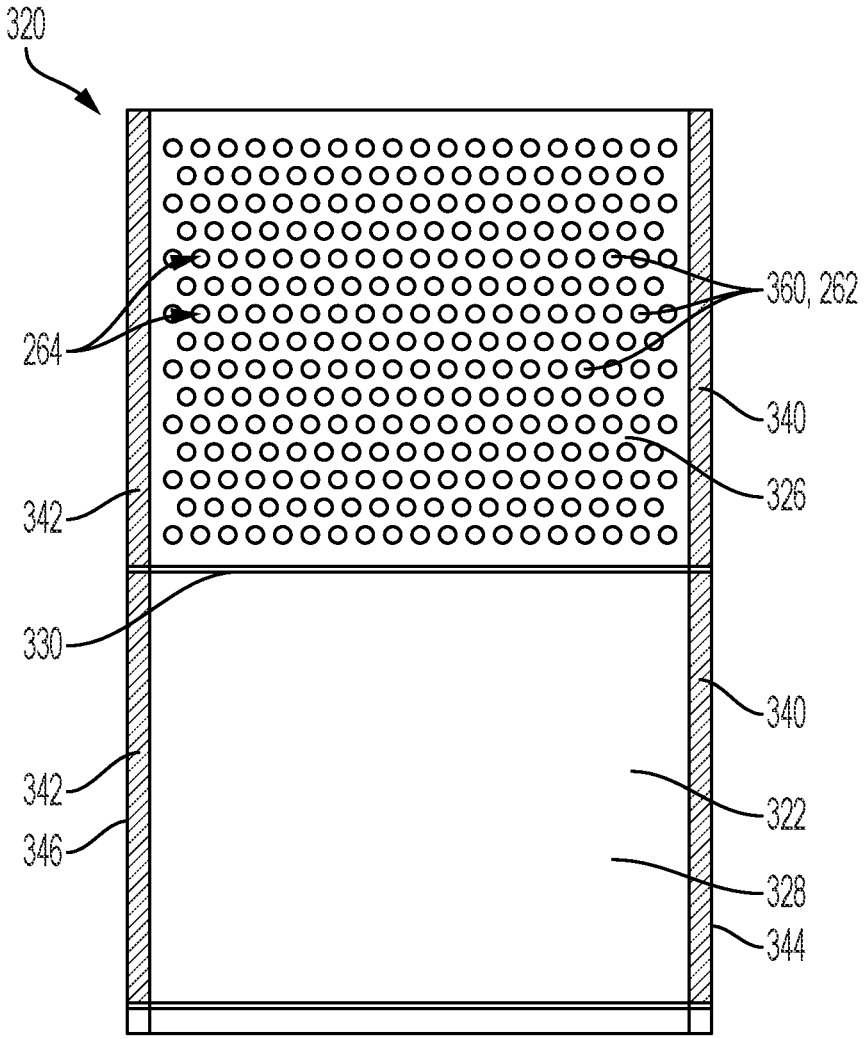
FIG. 3 is a top plan view of an inner layer of the textured mailer of FIG. 1.

FIG. 3 is a top plan view of the inner layer 320 in an unfolded configuration. According to example aspects, the inner layer 320 can be similar to the outer layer 120 (shown in FIG. 1). For example, like the outer layer 120, the inner layer 320 can comprise a paper material, and thus, the inner layer 320 can be a paper inner layer 320. In some aspects, the paper material can be recyclable, and in some aspects, the paper material can be single stream repulpable. Additionally, in some aspects, the paper material can be a tissue-grade paper material. Furthermore, in some aspects, a coating can be applied to the paper material of the inner layer 320 to increase the strength of the inner layer 320 while maintaining flexibility. The coating can be, for example and without limitation, a starch-based coating. In some aspects, the paper material can be extensible, such that the outer layer 120 can be stretchable. In other aspects, the inner layer 320 can comprise any other suitable material known in the art, may or may not comprise the coating, and/or can be inextensible.

Figure 4A:
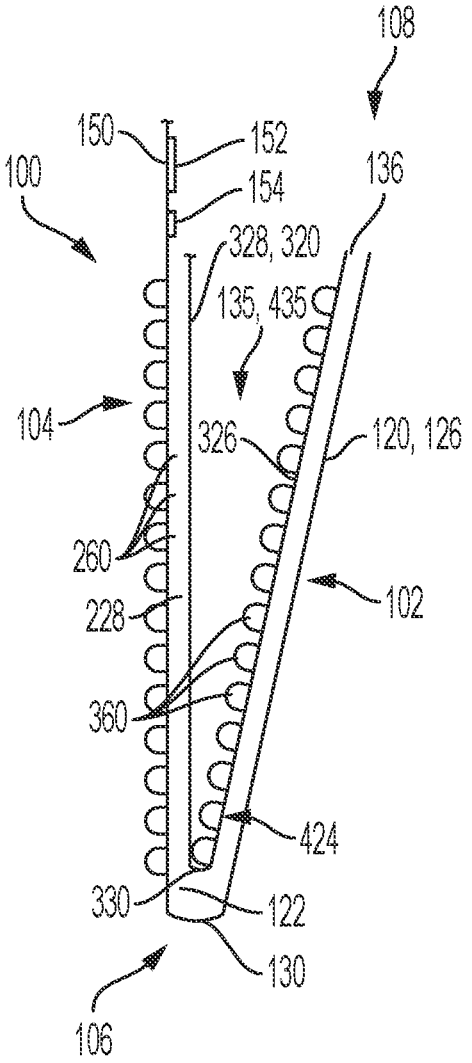
FIG. 4A is a cross-section view of the textured mailer of FIG. 1, taken along line 4-4 in FIG. 1.

The inner layer 320 can define an inner surface 322 and an outer surface 424 (shown in FIG. 4A). Example aspects of the inner layer 320 can comprise an inner front panel 326 and an inner rear panel 328. The inner front panel 326 can be hingedly connected to the inner rear panel 328 at a lower inner bend line 330, as shown. Each of the inner front panel 326 and the inner rear panel 328 can define a left coupling portion 340 extending along a left edge 344 thereof and a right coupling portion 342 extending along a right edge 346 thereof. Furthermore, according to example aspects, the inner rear panel 328 can be substantially smooth and planar, and the inner front panel 326 can be textured. In other aspects, the inner rear panel 328 can be textured, and the inner front panel 326 can be substantially smooth and planar. In other aspects, both of the inner front panel 326 and the inner rear panel 328 can be textured, or both of the inner front panel 326 and the inner rear panel 328 can be substantially smooth and planar. Like, the textured outer rear panel 228 (shown in FIG. 2) of the outer layer 120, the textured inner front panel 326 of the inner layer 320 can define a plurality of spaced-apart inner sockets 360 formed therein.

Figure 4B:
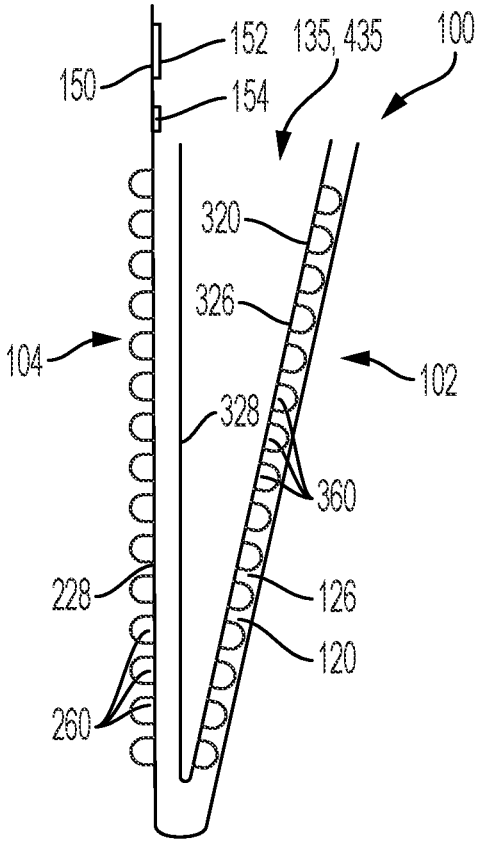
FIG. 4B is a cross-sectional view of the textured mailer in accordance with another aspect of the present disclosure

The inner sockets 360 can be substantially similar to the outer sockets 260. As described above, example aspects of the inner sockets 360 can be formed as the substantially semi-spherical domes 262, each dome 262 defining one of the substantially semi-spherical recesses 264. The inner sockets 360 can be substantially uniform in size and shape, and can extend in the same direction. For example, when assembled with the outer layer 120, each of the inner sockets 360 can extend rearwardly towards the rear side 104 (shown in FIG. 4A) of the textured mailer 100, as is illustrated in FIG. 4A. As such, the inner sockets 360 can extend out of the page in the present view. In other aspects, each of the inner sockets 360 can extend forwardly towards the front side 102 (shown in FIG. 4A) of the textured mailer 100, as is illustrated in FIG. 4B. In other aspects, the inner sockets 360 can vary in size and/or shape, and/or the inner sockets 360 can vary in direction (i.e., some of the inner sockets 360 can extend rearwardly towards the rear side 104 of the textured mailer 100 and some of the inner sockets 360 can extend forwardly towards the front side 102 of the textured mailer 100). The inner sockets 360 can also be arranged in any suitable pattern, such as in diagonal lines, as shown. The inner sockets 360 can be formed by the same method as the outer sockets 260, such as by a rolling machine.

FIG. 4A illustrates a cross-sectional view of the textured mailer 100 comprising the inner layer 320 and the outer layer 120. The textured mailer 100 is shown in a partially folded configuration as the textured mailer 100 is being folded to the folded configuration of FIG. 1. In the folded configuration, the inner layer 320 can be substantially disposed within the outer cavity 135 defined by the outer layer 120. According to example aspects, the inner layer 320 can be secured to the outer layer 120 while each of the outer and inner layers 120, 320 are in the unfolded configuration (shown in FIGS. 2 and 3). For example, the outer surface 424 of the inner layer 320 can be secured to the inner surface 122 of the outer layer 120 by any suitable fastener, such as by an adhesive, for example and without limitation. Specifically, the inner rear panel 328 can be secured to the outer rear panel 228, and the inner front panel 326 can be secured to the outer front panel 126. The adhesive can be applied to the outer surface 424 of the inner layer 320 only, to the inner surface 122 of the outer layer 120 only, or to both of the outer surface 424 and the inner surface 122. In some aspects, the adhesive can fully cover the outer surface 424 of the inner layer 320 and/or the inner surface 122 of the outer layer 120, and in other aspects, the adhesive can only partially cover the outer surface 424 and/or the inner surface 122. In other aspects, the inner layer 320 can be secured to the outer layer 120 by any other suitable fastener or fastening technique.

Furthermore, the left and right coupling portions 340, 342 (shown in FIG. 3) of the inner layer 320 can overlay the corresponding left and right sealing portions 140, 242 (shown in FIG. 2) of the outer layer 120. The inner front panel 326 of the inner layer 320 can then be folded towards the inner rear panel 328 of the inner layer 320, such that the inner front panel 326 and the outer front panel 126 can be disposed generally at the front side 102 of the textured mailer 100 and the inner rear panel 328 and the outer rear panel 228 can be disposed generally at the rear side 104 of the textured mailer 100. The left coupling portions 340 of the inner front panel 326 and the inner rear panel 328 can be captured and sealed between the left sealing portions 140 of the outer front panel 126 and the outer rear panel 228 at the left seam 114 (shown in FIG. 1). Similarly, the right coupling portions 342 of the inner front panel 326 and the inner rear panel 328 can be captured and sealed between the right sealing portions 242 of the outer front panel 126 and the outer rear panel 228 at the right seam 116 (shown in FIG. 1). The adhesive for sealing the left seam 114 and the right seam 116 can be applied to the left and right coupling portions 340, 342 only, the left and right sealing portions 140, 242 only, or to both the left and right coupling portions 340, 342 and the left and right sealing portions 140, 242. In other aspects, the inner layer 320 can be secured to the outer layer 120 only at the left and right seams 114, 116. Other aspects of the inner layer 320 may not be coupled to the outer layer 120 at all and can be loosely received within the outer cavity 135.

The inner surface 322 of the inner layer 320 can define an inner cavity 435 between the inner front panel 326 and the inner rear panel 328, which can overlap and include portions of the outer cavity 135. The cavity opening 136 can be defined generally at or near the upper end 108 of the textured mailer 100 and can allow access to the inner cavity 435 in the unsealed configuration, as shown. Contents can be inserted into the inner cavity 435 of the textured mailer 100 through the cavity opening 136. In the present aspect, the inner sockets 360 of the inner front panel 326 can extend into the inner cavity 435 and can cushion the textured mailer 100 at the front side 102 thereof. The inner rear panel 328 can be substantially smooth and planar, which can facilitate sliding contents (e.g., greeting cards, paper documents, etc.) into the inner cavity 435. The outer sockets 260 of the outer rear panel 228 can extend away from the inner rear panel 328 and can cushion the textured mailer 100 at the rear side 104 thereof. Thus, the inner cavity 435 and the contents therein can be substantially surrounded by the textured outer rear panel 228 and the texture inner front panel 326.

The inner cavity 435 can be sealed at the lower end 106 of the textured mailer 100 by the lower inner bend line 330. The inner cavity 435 can further be sealed at the left side 110 and the right side 112 by the left seam 114 and the right seam 116, respectively. The sealing flap 150 of the outer layer 120 can extend upward from the outer rear panel 228, relative to the orientation shown, beyond the inner rear panel 328. As described above, the sealing flap 150 can be folded over the cavity opening 136 and secured to the outer front panel 126 to seal the inner cavity 435 at the upper end 108 of the textured mailer 100 and to retain the contents therein.

FIG. 4B illustrates a cross-sectional view of the textured mailer 100 according to another example aspect of the present disclosure, wherein the inner sockets 360 of the inner front panel 326 can extend away from the inner cavity 435 towards the outer front panel 126. As shown, the outer sockets 260 of the outer rear panel 228 can extend away from the inner rear panel 328; however, in other aspects, the outer sockets 260 can extend towards the inner rear panel 328.

Figure 5:
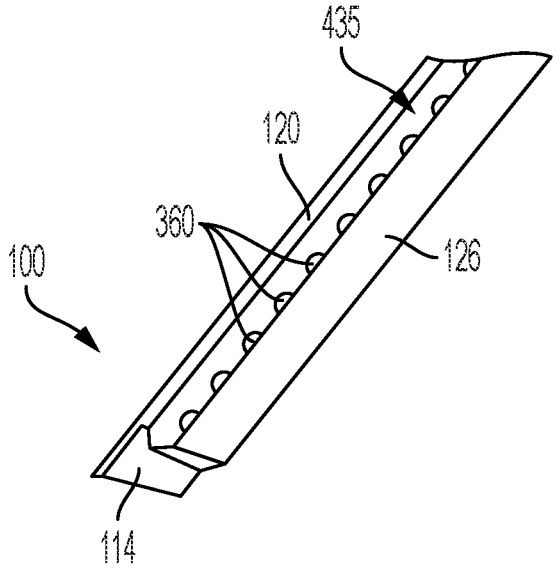
FIG. 5 is a top perspective view of the textured mailer of FIG. 1.
Figure 6:
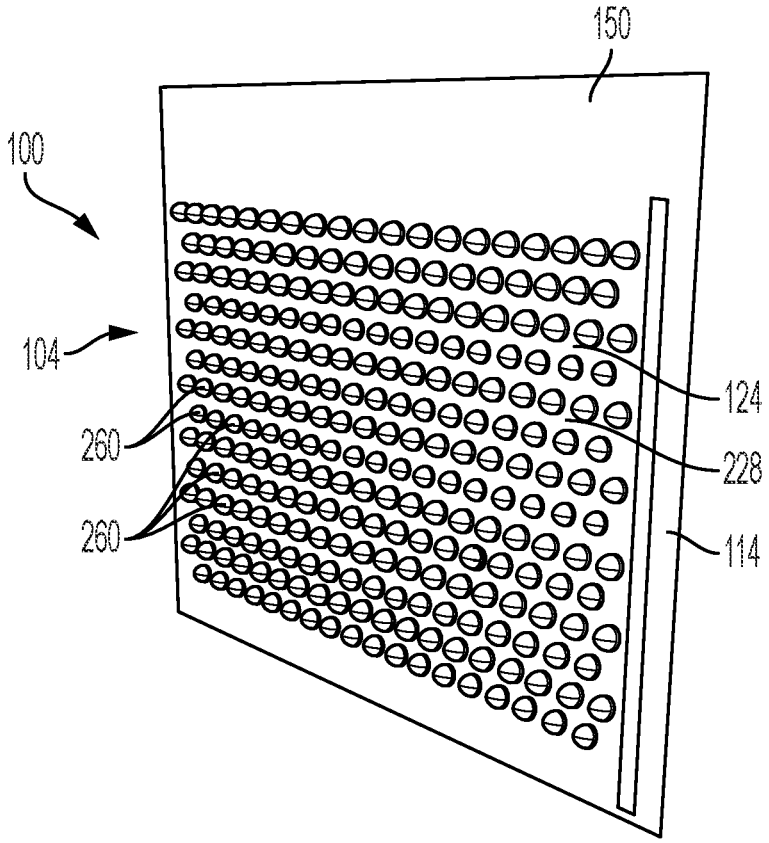
FIG. 6 is a rear perspective view of the textured mailer of FIG. 1.
Figure 7A:
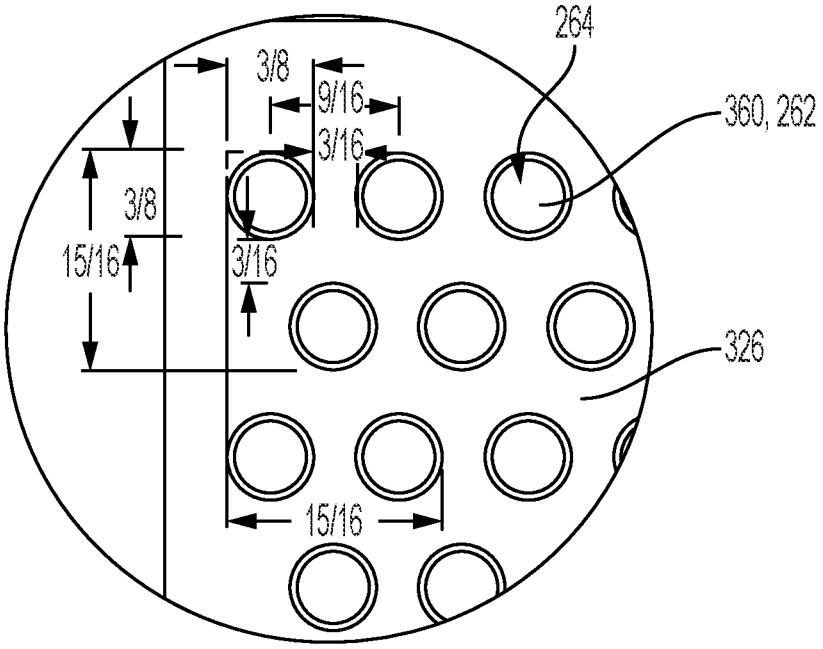
FIG. 7A is a detail view of the textured mailer of FIG. 1, showing example dimensions thereof.
Figure 7B:
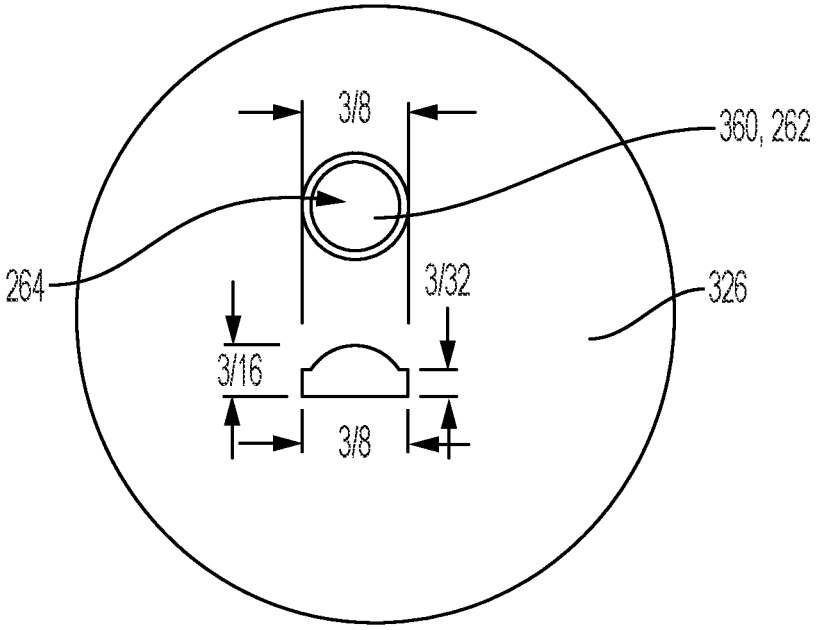
FIG. 7B is another detail view of the textured mailer of FIG. 1, showing example dimensions thereof.

FIG. 5 illustrates a top perspective view of the textured mailer 100, showing the inner sockets 360 extending into the inner cavity 435. FIG. 6 illustrates a rear perspective view of the textured mailer 100 showing the outer sockets 260 extending rearwardly from the rear side 104 of the textured mailer 100. FIGS. 7A and 7B illustrate example dimensions of the inner sockets 360, wherein the outer sockets 260 (shown in FIG. 2) can define the same dimensions or different dimensions. The dimensions disclosed herein are merely exemplary and should not be considered limiting.

Figure 8:
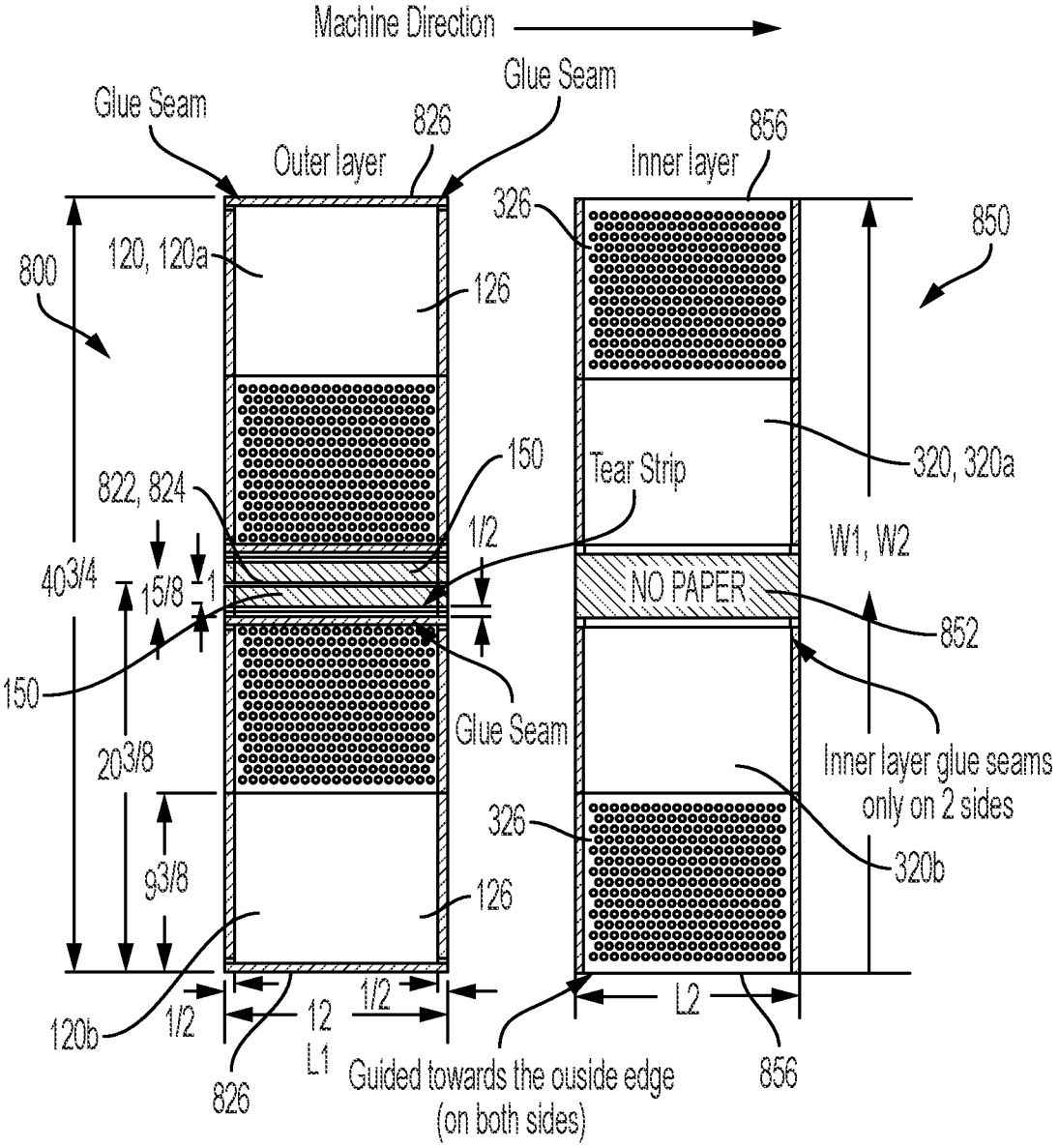
FIG. 8 is a top plan view of a first sheet comprising a plurality of the outer layers of FIG. 2 and a second sheet comprising a plurality of the inner layers of FIG. 3, in accordance with an example aspect of the present disclosure.

FIG. 8 illustrates a monolithic (i.e., formed as a singular component that constitutes a single material without joints or seams) first sheet 800 comprising a plurality of the outer layers 120, which can be produced by a rolling machine. The first sheet 800 can be fed through the rolling machine in the direction indicated by the directional arrow at the top of the page. In the present aspect, the first sheet 800 can comprise at least a first one of the outer layers 120*a* and a second one of the outer layers 120*b*. An upper edge 822 of the sealing flap 150 of the first outer layer 120*a* can meet and extend along the upper edge 822 of the sealing flap 150 of the second outer layer 120*b*. The upper edges 822 of the first and second outer layers 120*a,b* can generally define a cut line 824 or a cut region. To separate the first outer layer 120*a* from the second outer layer 120*b*, the first sheet 800 can be cut along the cut line 824.

Figure 9:
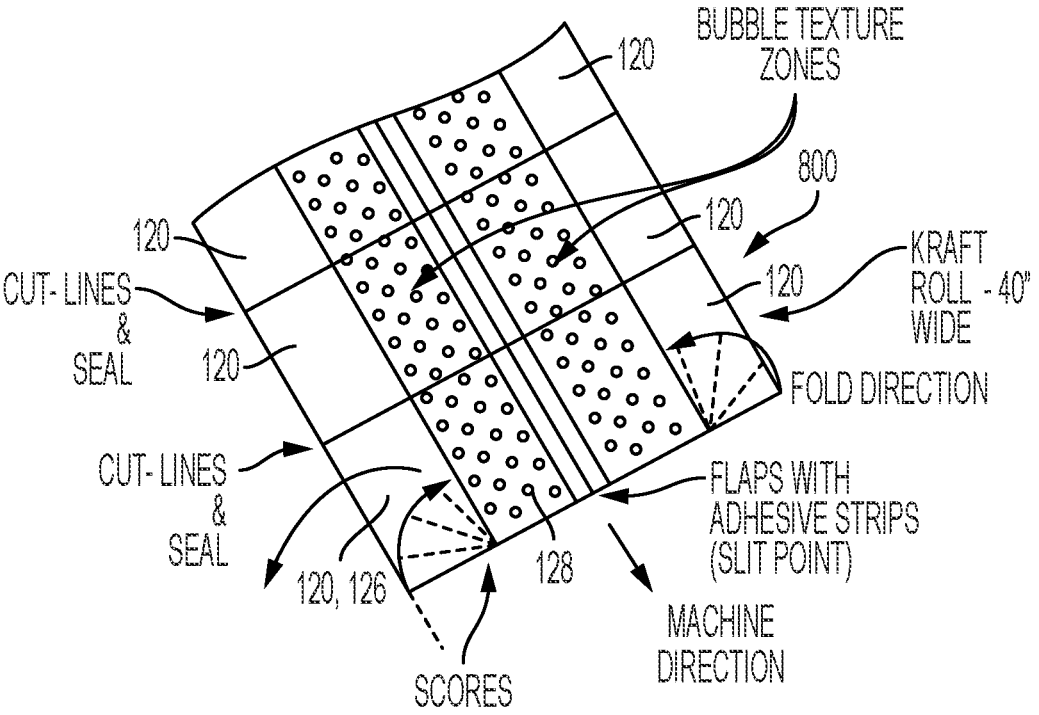
FIG. 9 is a top perspective view of the first sheet of FIG. 8.

As shown, the first sheet 800 can define a width W1. The width W1 can extend from a distal edge 826 of the outer front panel 126 of the first outer layer 120*a* to the opposing distal edge 826 of the outer front panel 126 of the second outer layer 120*b*. Thus, in the present aspect, the first sheet 800 can be two outer layers 120 wide. In other aspects, first sheet 800 can be more or fewer outer layers 120 wide. Additionally, as shown, the first sheet 800 can define a length L1. In the present aspect, the first sheet 800 can be one outer layer 120 long. However, as shown in FIG. 9, the first sheet 800 can comprise additional outer layers 120 along its length in other aspects.

Also illustrated in FIG. 8 is a second sheet 850 comprising a plurality of the inner layers 320, which can be produced by a roller machine. The second sheet 850 can be fed through the rolling machine in the direction indicated by the directional arrow at the top of the page. In the present aspect, the second sheet 850 can comprise at least a first one of the inner layers 320*a* and a second one of the inner layers 320*b*. In example aspects, the second sheet 850 can be a monolithic sheet prior to being fed through the rolling machine. However, in the present aspect, the rolling machine can be configured to cut out a center section of the second sheet 850 between the first inner layer 320*a* and the second outer layer 120*b* to define a gap 852 therebetween, thereby dividing the second sheet 850 into two separate parts.

Figure 10:
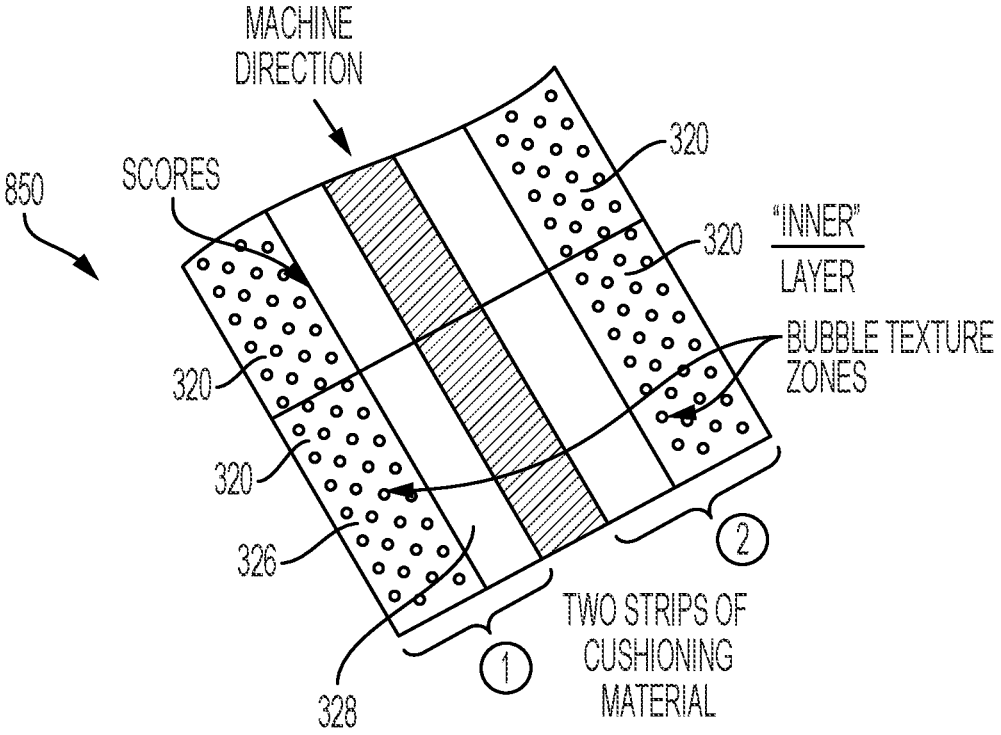
FIG. 10 is a top perspective view of the second sheet of FIG. 8.

As shown, the second sheet 850 can define a width W2. The width W2 can extend from a distal edge 856 of the inner front panel 326 of the first inner layer 320*a* to the opposing distal edge 856 of the inner front panel 326 of the second inner layer 320*b*. Thus, in the present aspect, the second sheet 850 can be two inner layers 320 wide, including the gap 852 defined therebetween. The width W2 can equal the width W1 in the present aspect. In other aspects, the second sheet 850 can be more or fewer inner layers 320 wide and/or the width W2 can be different than the width W1. Additionally, as shown, the second sheet 850 can define a length L2. In the present aspect, the second sheet 850 can be one inner layer 320 long and the length L2 can equal the length L1. However, as shown in FIG. 10, the second sheet 850 can comprise additional inner layers 320 along its length in other aspects and/or the length L2 can be different than the length L1. The various dimensions disclosed in FIG. 8 are merely exemplary and should not be considered limiting.

Figure 11:
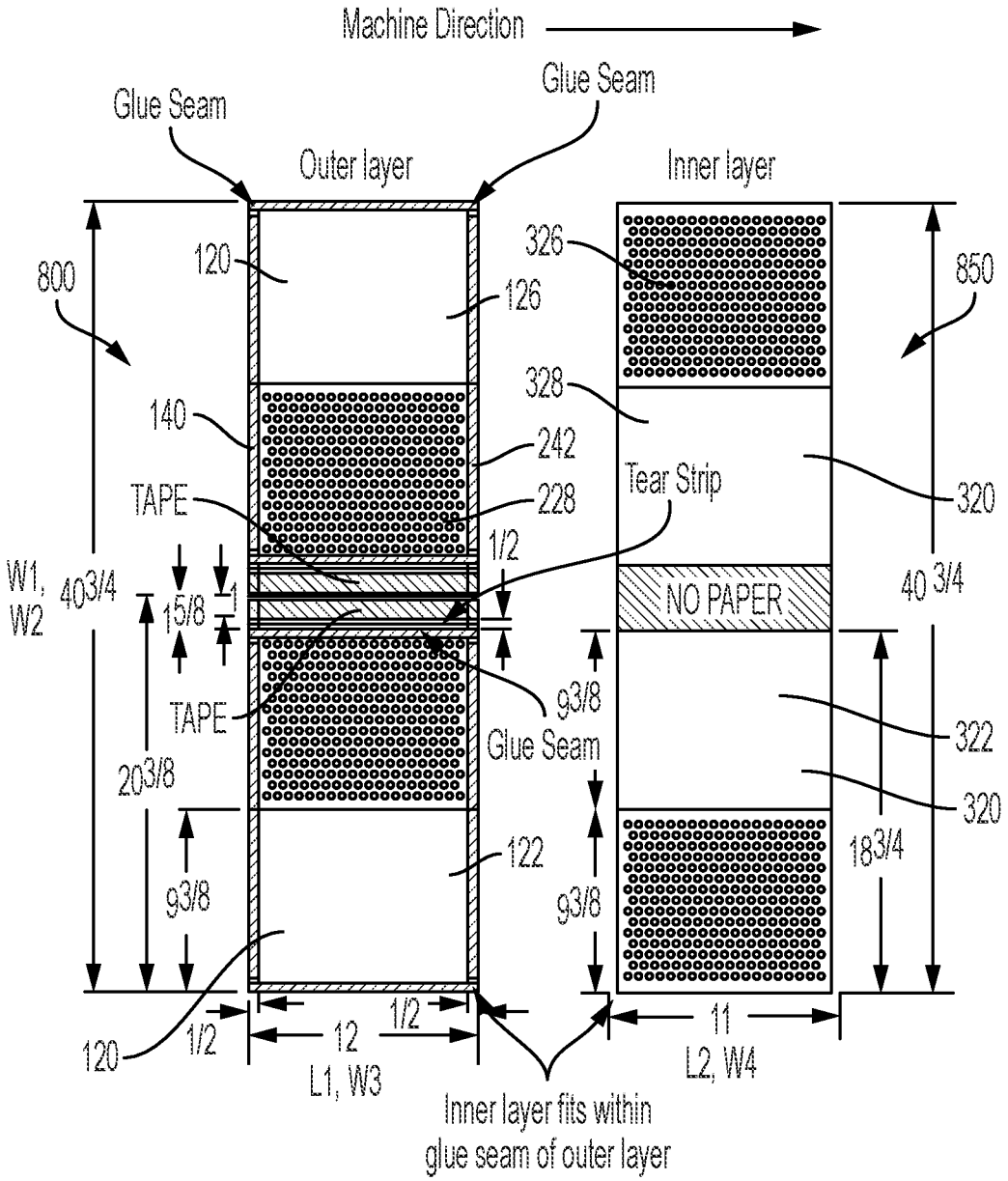
FIG. 11 is a top plan view of the first sheet and the second sheet, in accordance with another example aspect of the present disclosure.

FIG. 11 illustrates the first sheet 800 and the second sheet 850 of the textured mailer 100 (shown in FIG. 1), in accordance with another aspect of the present disclosure. The first sheet 800 can comprise a pair of the outer layers 120 and the second sheet 850 can comprise a pair of the inner layers 320. Each of the outer layers 120 can be substantially the same as the outer layers 120 previously described. Additionally, each of the inner layers 320 can be similar to the inner layers 320 previously described; however, in the present aspect, the inner layers 320 do not comprise the corresponding left and right coupling portions 340, 342 (shown in FIG. 3). Thus, a width W4 of each of the inner layers 320 can be less than a width W3 of each of the outer layers 120. It should be noted that the various dimensions disclosed in FIG. 11 are merely exemplary and should not be considered limiting.

To secure the inner layer 320 to the outer layer 120, the outer surface 424 (shown in FIG. 4) of the inner layer 320 can be coupled to the inner surface 122 of the outer layer 120, as described above. Specifically, the inner front panel 326 of the inner layer 320 can be coupled to the outer front panel 126 of the corresponding outer layer 120 between the left and right sealing portions 140, 242 of the outer layer 120. Similarly, the inner rear panel 328 can be coupled to the corresponding outer rear panel 228 between the left and right sealing portions 140, 242. The left sealing portion 140 of the outer front panel 126 can be adhered directly to the left sealing portion 140 of the outer rear panel 228 to define the left seam 114 (shown in FIG. 1), and the right sealing portion 242 of the outer front panel 126 can be adhered directly to the right sealing portion 242 of the outer rear panel 228 to define the right seam 116 (shown in FIG. 1).

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A textured mailer comprising:

a first panel comprising an inner surface, an outer surface, and at least a first paper layer;

a second panel coupled to and facing the first panel and comprising an inner surface, an outer surface, and at least a second paper layer; and an inner cavity defined between the inner surface of the first panel and the inner surface of the second panel, wherein one of the first paper layer and the second paper layer is formed as a textured paper layer defining a plurality of spaced apart sockets configured to provide cushioning to contents of the inner cavity and the other of the first paper layer and the second paper layer is substantially planar;

wherein at least one of the plurality of sockets extends outwardly from the outer surface of the corresponding one of the first panel and second panel; and wherein the first paper layer and the second paper layer are formed as a monolithic sheet.

2. The textured mailer of claim 1, wherein each of the sockets defining a socket recess.

3. The textured mailer of claim 2, wherein each of the sockets defines a substantially semi-spherical dome, each of the domes defining one of the socket recesses, each of the socket recesses being substantially semi-spherical.

4. The textured mailer of claim 2, wherein:

the textured mailer defines a left side, a right side, a bottom end, and a top end;

the first panel is joined to the second panel at the left side;

the first panel is joined to the second panel at the right side;

the first panel is joined to the second panel at the bottom end; and a cavity opening allowing access to the inner cavity is formed between at the top end.

5. The textured mailer of claim 4, wherein:

a sealing flap extends from the first panel at the top end of the textured mailer;

the textured mailer is configurable in an unsealed configuration and a sealed configuration;

in the unsealed configuration, the cavity opening is uncovered to allow access to the inner cavity; and in the sealed configuration, the cavity opening is covered by the sealing flap to seal the inner cavity at the top end.

6. The textured mailer of claim 5, wherein:

a tape strip extends substantially along a length of the sealing flap; and in the sealed configuration, the sealing flap is folded relative to the first panel over the cavity opening, and the tape strip is adhered to an outer surface of the second panel.

7. The textured mailer of claim 4, wherein the first paper layer is folded relative to the second paper layer at a lower bend line at the bottom end of the textured mailer.

8. The textured mailer of claim 4, wherein a length of the textured mailer from the left side to the right side is greater than a height of the textured mailer from the top end to the bottom end.

9. The textured mailer of claim 2, wherein:

the textured mailer further comprises an outer paper layer.

10. The textured mailer of claim 9, wherein the outer paper layer is substantially planar.

11. The textured mailer of claim 10, wherein at least one of the plurality of sockets extends toward the inner cavity and away from the outer paper layer.

12. The textured mailer of claim 10, wherein at least one of the plurality of sockets extends away from the inner cavity towards the outer paper layer.

13. The textured mailer of claim 9, wherein:

the textured mailer further comprises an inner paper layer; and the inner paper layer defines the inner cavity.

14. The textured mailer of claim 13, wherein the inner paper layer is substantially planar.

15. A textured mailer comprising:

a first paper layer comprising an inner surface and an outer surface; and a second paper layer coupled to the first paper layer and comprising an inner surface and an outer surface, the first and second paper layers folded to define an inner cavity;

wherein the first paper layer defines a first portion defining a plurality of sockets and a second portion that is substantially planar, and wherein the plurality of sockets is arranged at a front side of the textured mailer and the second portion of the first paper layer is arranged at a rear side of the textured mailer, the plurality of sockets extending outwardly from the outer surface of the first paper layer.

16. The textured mailer of claim 15, wherein the first paper layer is an outer paper layer, the second paper layer disposed between the inner cavity and the outer paper layer.

17. The textured mailer of claim 16, wherein the second paper layer is substantially planar.

18. The textured mailer of claim 17, wherein the textured mailer comprises an inner rear panel at the rear side and an inner front panel at the front side, the inner rear panel and the inner front panel define the inner cavity, and at least one of the inner rear panel and the inner front panel is substantially planar to facilitate sliding contents into the inner cavity.

19. The textured mailer of claim 18, wherein:

the textured mailer further comprises a sealing flap configurable in an unsealed configuration and a sealed configuration;

in the unsealed configuration, a cavity opening of the inner cavity is uncovered to allow access to the inner cavity; and in the sealed configuration, the cavity opening is covered by the sealing flap to retain the contents within the inner cavity.

20. The textured mailer of claim 19, wherein:

the sealing flap comprises an adhesive; and in the sealed configuration, the sealing flap is folded over the cavity opening and the adhesive is adhered to an outer surface of the outer paper layer.

* * * * *